US007597070B2

(12) United States Patent
Krolewski et al.

(10) Patent No.: US 7,597,070 B2
(45) Date of Patent: Oct. 6, 2009

(54) DUAL DRIVE RADIATOR FAN AND COOLANT PUMP SYSTEM FOR AN INTERNAL COMBUSTION ENGINE

(75) Inventors: David R. Krolewski, Clinton Township, MI (US); Mike W. Drawe, Canton, MI (US); Kathleen K. Drawe, legal representative, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 12/026,565

(22) Filed: Feb. 6, 2008

(65) Prior Publication Data

US 2009/0194045 A1 Aug. 6, 2009

(51) Int. Cl.
*F01P 7/02* (2006.01)
*F01P 5/10* (2006.01)

(52) U.S. Cl. ..... 123/41.11; 123/41.44; 123/41.46; 123/41.48

(58) Field of Classification Search ..... 123/41.11, 123/41.12, 41.44, 41.46, 41.47, 41.48, 41.49
See application file for complete search history.

(56) References Cited

U.S. PATENT DOCUMENTS

| | | | | |
|---|---|---|---|---|
| 1,274,678 | A | | 8/1918 | Butler |
| 2,045,870 | A | | 6/1936 | Paton |
| 2,452,264 | A | | 10/1948 | Russell |
| 2,506,547 | A | | 5/1950 | Findley |
| 2,788,775 | A | * | 4/1957 | Steiner ..... 123/41.46 |
| 2,911,962 | A | * | 11/1959 | McRae ..... 123/41.11 |
| 3,037,600 | A | * | 9/1962 | Heckethorn ..... 192/45.1 |
| 3,661,237 | A | * | 5/1972 | Thompson ..... 123/41.11 |
| 3,702,083 | A | * | 11/1972 | Hewko et al. ..... 475/184 |
| 4,064,980 | A | * | 12/1977 | Tinholt ..... 123/41.12 |
| 5,415,134 | A | | 5/1995 | Stewart, Jr. |
| 6,439,172 | B1 | | 8/2002 | McGovern et al. |
| 6,802,283 | B2 | | 10/2004 | Liederman et al. |
| 2002/0096132 | A1 | | 7/2002 | Stretch et al. |

FOREIGN PATENT DOCUMENTS

| | | |
|---|---|---|
| JP | 60-22020 | 2/1985 |

* cited by examiner

*Primary Examiner*—Noah Kamen
(74) *Attorney, Agent, or Firm*—Dickinson Wright PLLC; Julia Voutyras

(57) ABSTRACT

A dual drive radiator fan and coolant pump system for a liquid-cooled reciprocating internal combustion engine includes a coolant pump with an impeller shaft driven by a first drive extending between the engine's crankshaft and a pump pulley and hub mounted upon the impeller shaft. A second drive extends between the crankshaft and a fan hub journaled upon the pump hub, so that the coolant pump and fan hub are driven independently.

4 Claims, 3 Drawing Sheets

DUAL DRIVE RADIATOR FAN AND COOLANT PUMP SYSTEM FOR AN INTERNAL COMBUSTION ENGINE

CROSS REFERENCE TO RELATED APPLICATIONS

None.

BACKGROUND OF THE INVENTION

1. Field of the Invention

The subject matter disclosed herein relates to coolant pump and radiator fan drive for use with a reciprocating liquid-cooled internal combustion engine.

2. Related Art

Liquid-cooled reciprocating internal combustion engines typically employ a coolant pump (commonly termed a "water pump"), to circulate coolant between a heat exchanger, commonly termed a "radiator," and the engine. The radiator is an air-to-liquid heat exchanger which usually has a fan to pull ambient air through the radiator core. On heavy duty vehicles, the fan is usually powered by the engine's crankshaft. With most engines, the fan and a pump impeller are mounted on a single shaft extending through the coolant pump to a fan clutch. Unfortunately, with this arrangement it is not possible to drive the fan at a speed which is different from the water pump speed except by the use of a fan clutch, which is allowed to slip, so as to drive the fan at a slower speed than the water pump during certain operating conditions. Under some conditions, it is not desirable to drive the fan and water pump or coolant pump at the same speed; with some engines, it may be desirable to drive the fan at a slower speed or at a greater speed than the coolant pump.

It would be desirable to provide a dual drive for a liquid coolant pump and radiator fan, permitting the fan and coolant pump to be driven independently, so as to permit optimal tuning of the pump and fan drive speeds.

BRIEF DESCRIPTION OF THE INVENTION

According to an aspect of the invention, a dual drive radiator fan and coolant pump system for a liquid-cooled reciprocating internal combustion engine includes a coolant pump having an impeller shaft driven by a first drive extending between the engine's crankshaft and the impeller shaft. A fan hub is journaled upon the impeller shaft, and a second drive extends between the crankshaft and the fan hub.

According to another aspect of the present invention, the first drive may include a first driving pulley attached to the crankshaft, and a coolant pump pulley attached to the impeller shaft. A first composite drive belt extends between the first driving pulley and the coolant pump pulley. The second drive preferably includes a second driving pulley attached to the crankshaft, and a fan pulley attached to the fan hub. A second composite drive belt extends between the second driving pulley and the fan pulley. A fan is attached to the fan hub.

According to another aspect of the present invention, either an anti-friction bearing or an overrunning clutch is interposed between the fan hub and the impeller shaft. If an overrunning clutch is employed, failure of one of the drive belts may occasion the use of the single surviving drive belt to power not only the fan hub, but also the coolant pump.

It is an advantage of a dual drive radiator fan and coolant pump system according to the present invention that the packaging of the fan drive and water pump or coolant pump drive is very compact and low in weight and mass.

It is another advantage of a dual drive radiator fan and coolant pump system according to the present invention that parasitic losses are reduced because the fan hub is journaled upon the coolant pump's impeller shaft, which is always rotating when the engine is in operation.

It is yet another advantage of a dual drive radiator fan and coolant pump system according to the present invention that failure of one of the drive belts may be compensated for through the use of an overrunning clutch between the fan hub and the impeller shaft.

It is yet another advantage of a dual drive radiator fan and coolant pump system according to the present invention that excessive fan noise may be abated because the fan may be turned at a lower speed, while nevertheless maintaining the water pump speed at a higher value.

Other advantages, as well as features of the present invention, will become apparent to the reader of this specification.

DETAILED DESCRIPTION OF THE PREFERRED EMBODIMENTS

Figure 1:
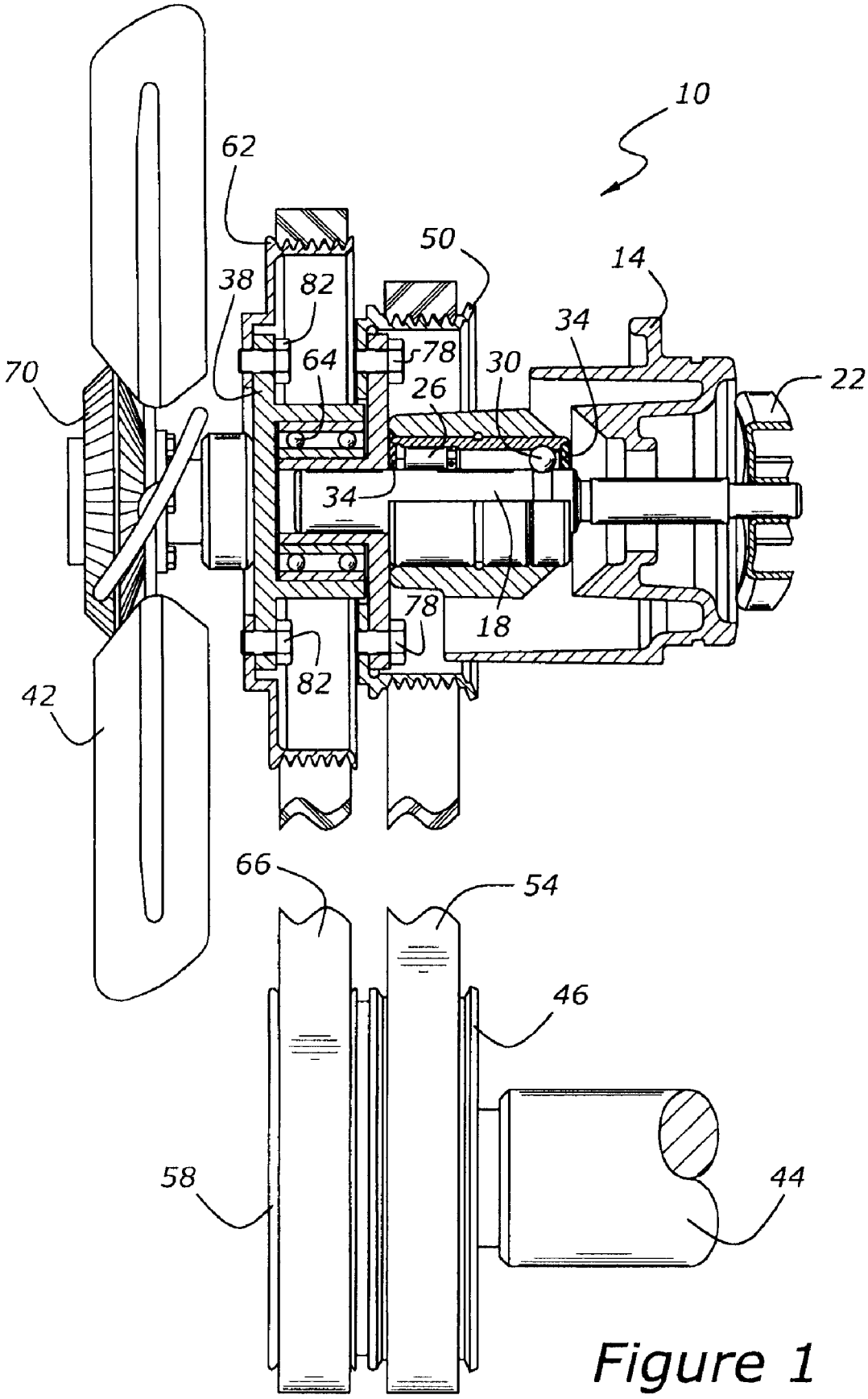
FIG. 1 is a partially schematic representation of a dual drive radiator fan and coolant pump system according to an aspect of the present invention.
Figure 2:
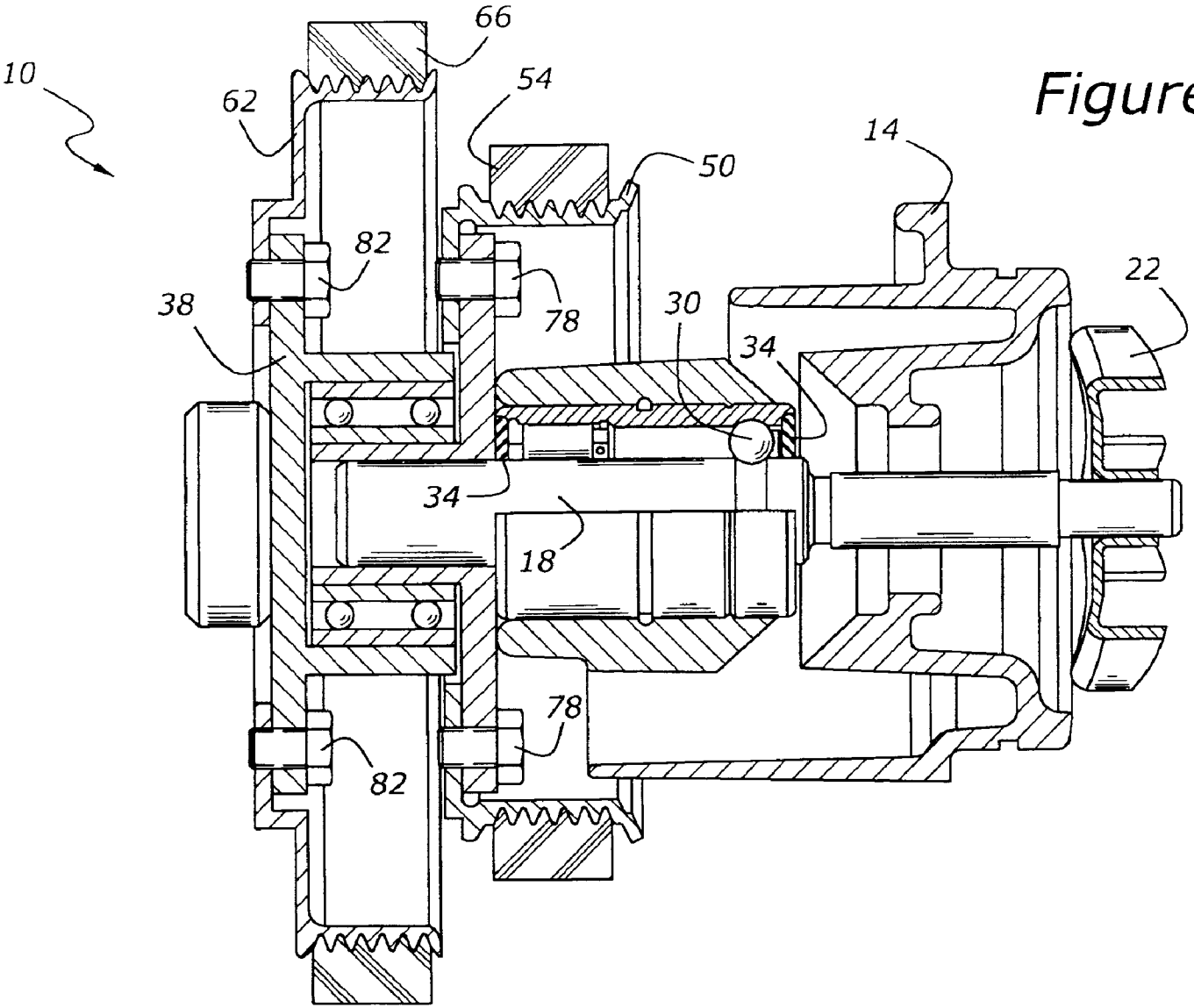
FIG. 2 is an enlarged view of a portion of FIG. 1.

As shown in FIGS. 1 and 2, a dual drive radiator fan and coolant pump system, 10, includes a coolant pump, 14, having an impeller, 22, mounted upon an impeller shaft, 18, which is driven by the engine's crankshaft, 44. Pump drive flange 52 is fit upon a forward portion of impeller shaft 18. Pump drive flange 52 is driven by pump pulley 50, which is powered by first composite drive belt 54, which is connected with a first driving pulley, 46, which, in turn is rotationally locked to crankshaft 44. Drive flange 52 and pump pulley 50 are connected by several fasteners 78.

Pump drive flange 52 has a cylindrical extension 52A upon which a double row ball type of fan bearing 64 is mounted. Bearing 64, although illustrated as a double row ball bearing, is merely illustrative of a class of anti-friction bearings suitable for mounting fan hub 38 upon pump drive flange 52.

Although fan hub 38 is mounted upon coolant pump drive flange 52, fan bearing 64 causes fan hub 38 to be unpowered. In other words, bearing 64 prevents the transmission of any significant torque from coolant pump drive flange 52 to fan hub 38. Instead, fan hub 38 is powered by a second drive including fan pulley 62, which is bolted to fan hub 38 by fasteners 82. Fan pulley 62 is powered by crankshaft 44 through the utility of second driving pulley 58 and second drive belt 66. Both first drive belt 54 and second drive belt 66 are preferably composite belts having cord reinforced elastomeric cross sections. Although both fan pulley 62 and pump pulley 50 are shown as being bolted to their respective mountings, it should be understood that these pulleys may be installed by pressing or welding, it being clear that these details are beyond the scope of the present invention.

Fan 42 is shown as being attached to fan hub 38 by fan clutch 70. Those skilled in the art will appreciate, in view of this disclosure however, that fan 42 could be attached directly with fan hub 38 without the intervention of fan clutch 70. Those skilled in the art will further appreciate, in view of this disclosure, that fan clutch 70 could be actuated either thermostatically or by a powertrain control module or by other devices or systems which are beyond the scope of this invention.

Figure 3:
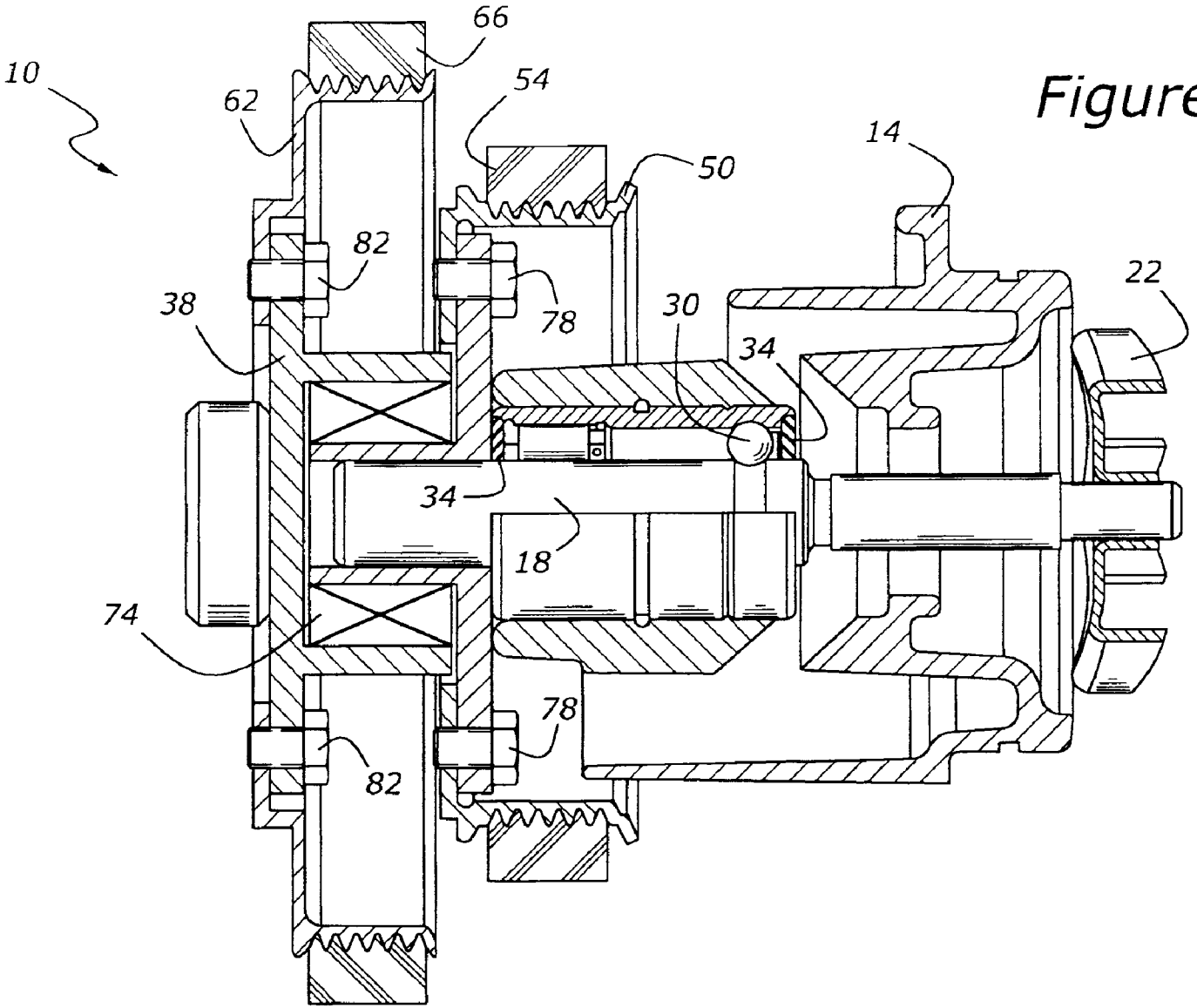
FIG. 3 is similar to FIG. 2, but illustrates an overrunning clutch interposed between the fan hub and impeller shaft.

FIG. 3 shows an embodiment which is similar to that of FIGS. 1 and 2, but which illustrates an overrunning clutch, 74, interposed between fan hub 38 and coolant pump drive flange 52. In the absence of overrunning clutch 74, an antifriction bearing illustrated in FIGS. 1 and 2 at 64 is used between fan hub 38 and coolant pump drive flange 52. This means that the relative speeds of impeller 22 and fan 42 will be governed solely by the drive pulley ratios. For example, if both pulleys 46 and 58 are the same diameter, fan 42 will operate at a lower rotational speed than coolant pump 14 merely because the diameter of fan pulley 62 is greater than the diameter of coolant pump pulley 50. Moreover, if one of drive belts 54 or 66 were to break, either fan 42 or coolant pump 14 would stop rotating.

If overrunning clutch 74 is employed instead of bearing 64, overrunning clutch 74 may be configured to sense a mismatch in the rotational speeds of impeller shaft 18 and fan hub 38 resulting from the loss of either drive belt. This rotational speed mismatch will result in the locking of the fan hub 38 to coolant pump drive flange 52. Then, the survivor of first drive belt 54 and second drive belt 66 may be used to transmit power to both coolant pump 14 and fan 42.

Overrunning clutch 74 may be either single directional or bi-directional. If bi-directional, clutch 74 may be used to accommodate the failure of either of the first or second drive belts 54 and 66. If uni-directional, overrunning clutch 74 may be used to compensate for the failure of either, but not both, of drive belts 54 and 66.

The foregoing invention has been described in accordance with relevant legal standards, thus the description is exemplary rather than limiting in nature. Variations and modifications to the disclosed embodiments may become apparent to those skilled in the art and such variations and modifications fall within the scope of the invention. Accordingly, the scope of legal protection afforded this invention can only be determined by studying the following claims.

What is claimed is:

1. A dual drive radiator fan and coolant pump system for a liquid-cooled reciprocating internal combustion engine, comprising:

a coolant pump having an impeller shaft driven by a first drive extending between the engine's crankshaft and said impeller shaft;

a fan hub journaled upon said impeller shaft;

a fan assembly attached to said fan hub;

a second drive extending between the crankshaft and said fan hub; and an overrunning clutch interposed between said fan hub and said impeller shaft.

2. A dual drive radiator fan and coolant pump system according to claim 1, wherein said overrunning clutch is configured so that said first drive will provide operating torque to said coolant pump and to said fan hub if said second drive becomes inoperative.

3. A dual drive radiator fan and coolant pump system according to claim 1, wherein said overrunning clutch is configured so that said second drive will provide operating torque to said coolant pump and to said fan hub if said first drive becomes inoperative.

4. A dual drive radiator fan and coolant pump system according to claim 1, wherein said overrunning clutch is configured to lock said fan hub to said impeller shaft if either said first drive or said second drive becomes inoperative.

* * * * *